US007131412B2

(12) United States Patent
Tsutsumi et al.

(10) Patent No.: US 7,131,412 B2
(45) Date of Patent: Nov. 7, 2006

(54) ENGINE STARTING SYSTEM

(75) Inventors: Koichi Tsutsumi, Wako (JP); Hidetoshi Takamatsu, Wako (JP); Katsuhiro Nakamichi, Wako (JP); Hiroyuki Sugiura, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 10/895,661

(22) Filed: Jul. 21, 2004

(65) Prior Publication Data

US 2005/0039717 A1 Feb. 24, 2005

(30) Foreign Application Priority Data

Aug. 20, 2003 (JP) ..... 2003-296299

(51) Int. Cl.
*F02N 15/02* (2006.01)

(52) U.S. Cl. ..... 123/179.25; 74/7 E

(58) Field of Classification Search ..... None
See application file for complete search history.

(56) References Cited

U.S. PATENT DOCUMENTS 5,966,985 A * 10/1999 Shuto et al. ..... 123/179.25
2004/0255890 A1* 12/2004 Tsutsumi et al. ..... 123/179.24
2005/0039718 A1* 2/2005 Tsutsumi et al. ..... 123/196 R

FOREIGN PATENT DOCUMENTS

JP 2002-54540 2/2002

* cited by examiner

*Primary Examiner*—Andrew M. Dolinar
(74) *Attorney, Agent, or Firm*—Hamre, Schumann, Mueller & Larson, P.C.

(57) ABSTRACT

The invention is directed at a device that reduces the size of an engine in the direction along the axis of a crankshaft. More specifically, it relates to an engine starting system in which a part of a starting power transmission gear train is provided between one end portion of a crankshaft rotatably borne on a crankcase and a starter motor mounted to the crankcase is covered from the outside by an accessory coupled to and operated in conjunction with the crankshaft.

3 Claims, 7 Drawing Sheets

ENGINE STARTING SYSTEM

TECHNICAL FIELD

The present invention relates to an engine starting system. More specifically, the invention relates to an arrangement of a starting power transmission.

BACKGROUND OF THE INVENTION

Starting systems are known. See, for example, Japanese Patent No. 2002-54540.

In prior art starting systems, a part of the starting power transmission gear train is typically covered from the outside by a shift gear switching clutch that is coupled to and operated in conjunction with the crankshaft. In the prior art starting systems, the gears constituting a part of the starting power transmission gear train and covered with the clutch are borne in a center gear manner. Accordingly, the amount of outward projection of the clutch along the axis of the crankshaft is comparatively large, leading to an increase in the size of the engine, which is generally not desired.

The present invention has been made in consideration of the above-mentioned drawback as well as other known drawbacks of starting systems. For example, it is an object of the present invention to provide an engine starting system which makes it possible to reduce the size of the engine in the direction of the axis of the crankshaft.

SUMMARY OF THE INVENTION

The invention is directed at an engine starting system that includes a starting power transmission gear train provided between one end portion of a crankshaft rotatably borne on a crankcase and a starter motor mounted to the crankcase. A part of the starting power transmission gear train is covered from the outside by an accessory coupled to and operated in conjunction with the crankshaft. Of gears that constitute the starting power transmission gear train, a plurality of gears exclusive of the driven gear on the side of the one end portion of the crankshaft and the drive gear fixed to an output shaft of the starter motor are borne on the crankcase in a cantilever manner.

The gears constituting a part of the starting power transmission gear train and covered with the accessory are borne on the crankcase in a cantilever manner, so that it is possible to dispose the accessory closer to the crankcase side in the direction of the axis of the crankshaft, and to reduce the size of the engine in the direction of the axis of the crankshaft.

In addition, in some embodiments the one-end sides of a plurality of support shafts are fixed to a holder plate attached to the crankcase, and the plurality of gears exclusive of the driven gear and the drive gear, of the gears constituting the starting power transmission gear train, are rotatably borne on the other-end sides of the support shafts. The holder plate is attached to the crankcase, so that the mountability is enhanced.

In other embodiments the one end of the support shaft which is the nearest to the drive gear of the plurality of support shafts is projected from the holder plate to the side of the crankcase and is fitted in the crankcase.

It is possible to enhance the mountability of the holder plate onto the crankcase while contriving a reduction in the number of component parts by utilizing one of the plurality of support shafts as a knock pin. Also, since support rigidity can be enhanced by supporting on the crankcase the support shaft for the gear to be rotated at a high speed, it is possible to contrive enhancement of durability and to reduce the meshing noise.

DETAILED DESCRIPTION OF THE INVENTION

Figure 1:
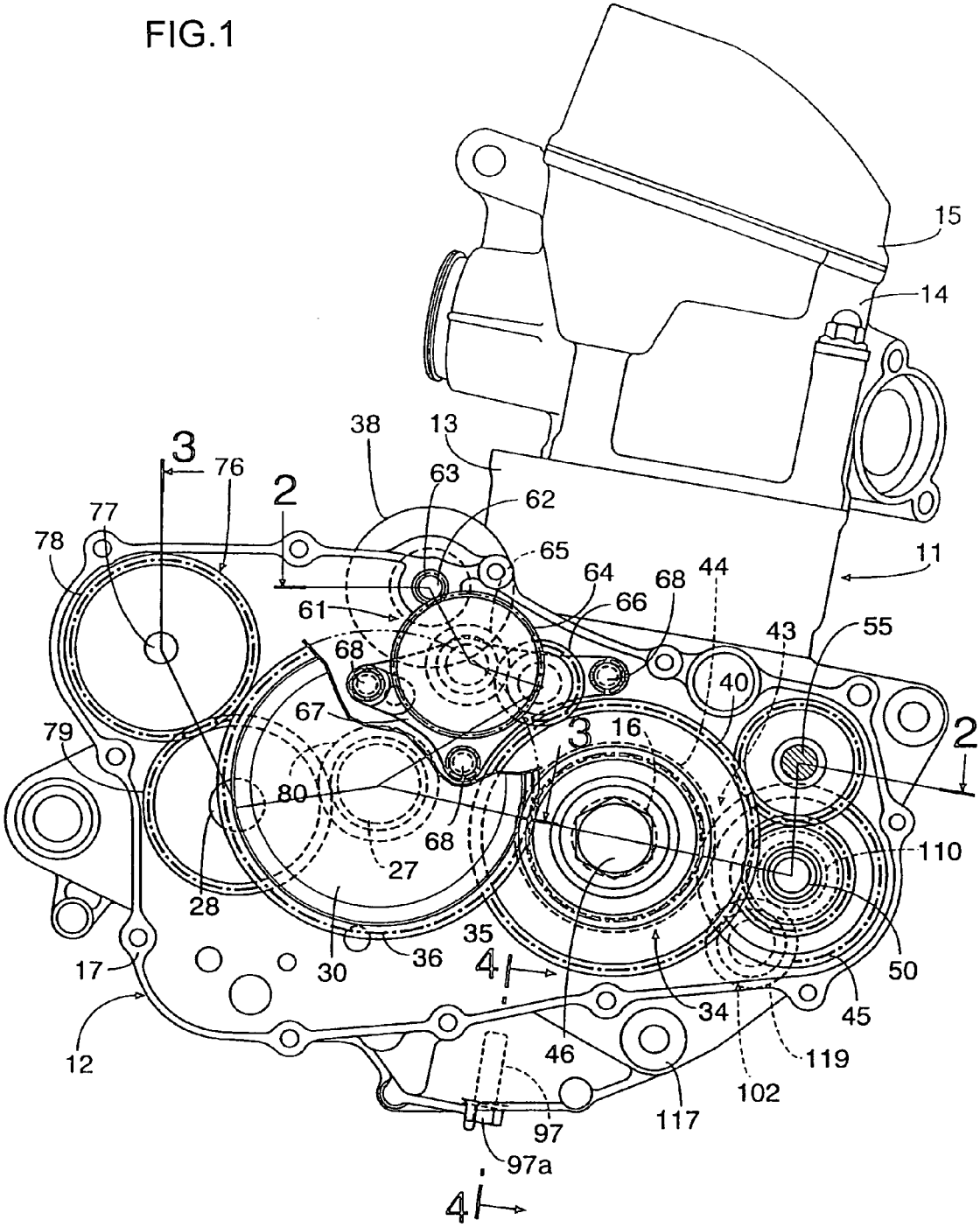
FIG. 1 is a vertical sectional side view of an engine, being a sectional view along line 1—1 of FIG. 2.

Referring to FIG. 1, a single-cylinder four-cycle engine that is adapted to be mounted on a vehicle such as a motorcycle is shown. The engine main body 11 comprises a crankcase 12, a cylinder block 13 coupled to the crankcase 12, a cylinder head 14 coupled to the cylinder block 13, and a head cover 15 coupled to the cylinder head 14.

Figure 2:
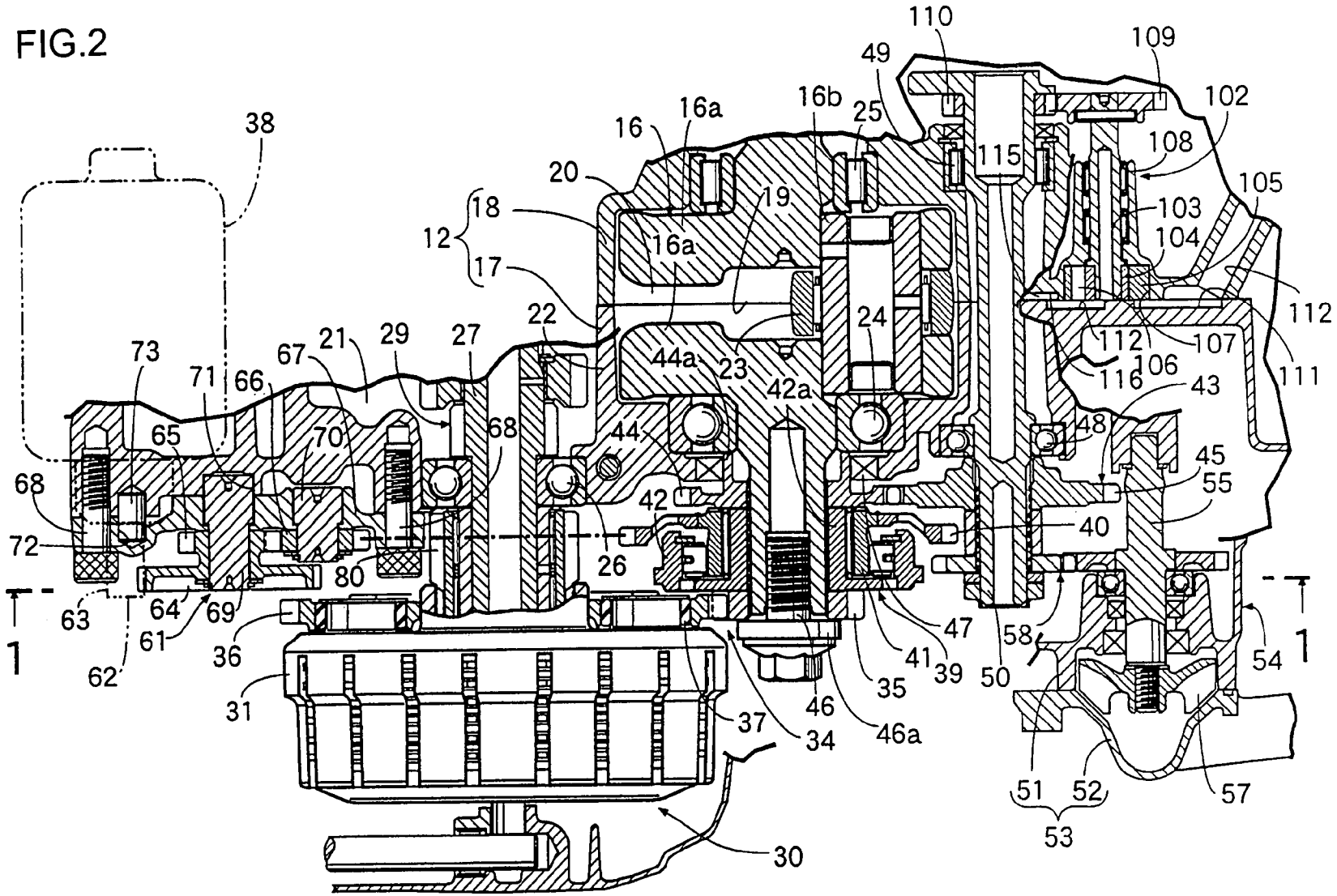
FIG. 2 is a sectional view along line 2—2 of FIG. 1.

Referring to FIG. 2 also, the crankcase 12 for rotatably bearing a crankshaft 16 comprises a right case half 17 disposed on the right side at the time of mounting on the motorcycle, and a left case half 18 disposed on the left side at the time of mounting on the motorcycle. The case halves 17 and 18 are coupled to each other at a mating surface 19 along a plain surface orthogonal to the axis of the crankshaft 16 and are formed of an aluminum alloy. Moreover, a crank chamber 20 for containing an essential part of the crankshaft 16 and a transmission chamber 21 for containing a normally meshed type transmission are formed in the crankcase 12 in the state of being partitioned from each other by a partition wall 22.

The essential part of the crankshaft 16, which comprises a pair of crank webs 16*a*, 16*a* and a crank pin 16*b* for connection between the crank webs 16*a*, 16*a*, is contained in the crank chamber 20, and a large end portion of a connecting rod 23 continuous with a piston (not shown) slidably fitted in the cylinder block 13 is connected to the crank pin 16*b*.

One end portion of the crankshaft 16 rotatably penetrates through the right case half 17, and the other end portion of the crankshaft 16 rotatably penetrates through the left case half 18. A ball bearing 24 is intermediately provided between the right case half 17 and the crankshaft 16, while a roller bearing 25 is intermediately provided between the left case half 18 and the crankshaft 16.

Figure 3:
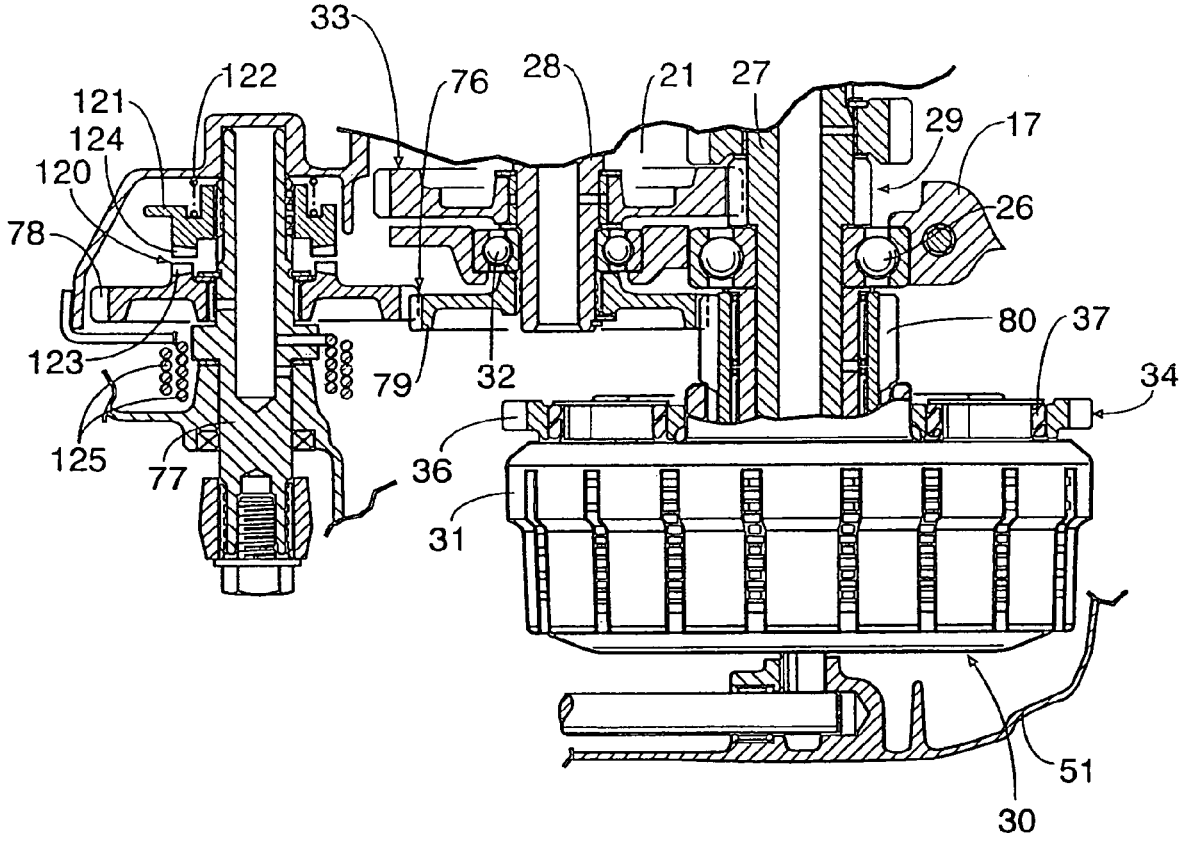
FIG. 3 is a sectional view along line 3—3 of FIG. 1.

Referring to FIG. 3 also, the transmission comprises a main shaft 27 having an axis parallel to the crankshaft 16 and rotatably borne on the right and left case halves 17 and 18 through ball bearings 26, respectively, and a counter shaft 28 having an axis parallel to the main shaft 27 and rotatably borne on both the case halves 17 and 18 through ball bearings 32. A drive gear group 29 for a plurality of speed change stages is mounted to the main shaft 27, while a driven gear group 33 corresponding to the drive gear group 29 is mounted to the counter shaft 28. By selective establishment of mutually corresponding gears among the drive gear group 29 and the driven gear group 33, the output of the engine is transmitted to the counter shaft 28 through a plurality of speed change stages.

A shift gear switching clutch 30 for switching ON and OFF the power between the crankshaft 16 and the main shaft 27 is mounted as an accessory to one end portion of the main shaft 27 which projects from the right case half 17, and an input member 31 possessed by the shift gear switching clutch 30 is relatively rotatably borne on the main shaft 27.

A power transmission gear train 34 is provided between the input member 31 of the shift gear switching clutch 30 and the crankshaft 16. The power transmission gear train 34 is comprised of a first drive gear 35 fixed to one end portion of the crankshaft 16, and a clutch gear 36 meshed with the first drive gear 35. The clutch gear 36 is connected to the input member 31 through a damper 37, and is rotated together with the input member 31.

In addition, a starter motor 38 having a rotational axis parallel to the main shaft 27 is mounted to the right case half 17 on the upper side of the main shaft 27. A starter one-way clutch 39 shown in FIG. 2 intermediately provided between the starter motor 38 and the crankshaft 16 is disposed between the drive gear group 29 shown in FIG. 3 and the clutch gear 36 along the direction of the axis of the main shaft 27, and is mounted to the one end portion of the crankshaft 16.

The starter one-way clutch 39 comprises a clutch inner 41 shown in FIG. 2 to which a free wheel gear 40 shown in FIG. 1 as a driven gear supplied with power from the starter motor 38 is attached, and a clutch outer 42 shown in FIG. 2 having an inner circumference boss portion 42a relatively rotatably bearing the clutch inner 41 and being relatively non-rotatably mounted to the crankshaft 16, and the inner circumference boss portion 42*a* is disposed between the first drive gear 35 and a second drive gear 44 constituting a part of an accessory-driving power transmission gear train 43 and fixed to the crankshaft 16.

The first drive gear 35, the inner circumference boss portion 42*a* of the clutch outer 42, and the second drive gear 44 are relatively non-rotatably mounted to the crankshaft 16 by spline fit or the like while making contact with each other. The second drive gear 44 is integrally provided with a cylinder portion 44*a* making contact with the inner ring outside surface of the ball bearing 24 interposed between the crankshaft 16 and the crankcase 12 on the inner side in the axial direction relative to the second drive gear 44. A bolt 46 having a radially enlarged head portion 46*a* making contact and engagement with the outer end of the first drive gear 35 is coaxially screw-engaged with the one end portion of the crankshaft 16.

As a result, the starter one-way clutch 39 and the second drive gear 44 are disposed side by side between the first drive gear 35 and the ball bearing 24, and an annular oil seal 47 is interposed between the cylinder portion 44*a* and the right case half 17.

The accessory-driving power transmission gear train 43 is provided between the crankshaft 16 and a balancer shaft 50 which is rotatably borne on the right case half 17 and the left case half 18 through the ball bearing 48 and the roller bearing 49 on the front side of the crankshaft 16, and is comprised of the second drive gear 44 fixed to the crankshaft 16, and a first driven gear 45 fixed to one end portion of the balancer shaft 50 and meshed with the second drive gear 44.

Besides, a water pump 54 in which a pump housing 53 is comprised of a right cover 51 connected to the right case half 17 from the outside and a pump cover 52 fastened to the outside surface of the right cover 51 is disposed on the upper side of the balancer shaft 50. The water pump 54 comprises a pump shaft 55 parallel to the balancer shaft 50.

The pump shaft 55 penetrates through the right cover 51 of the pump housing 53 in a liquid-tight and rotatable manner. Rotary vanes 57 are coaxially attached to one end portion of the pump shaft 55 projected into the inside of the pump housing 53, and the other end portion of the pump shaft 55 is rotatably borne on the right case half 17.

A transmission gear train 58 is provided between one end portion of the balancer shaft 50 and the pump shaft 55, and the power transmitted from the crankshaft 16 to the balancer shaft 50 through the accessory-driving power transmission gear train 43 is transmitted to the pump shaft 55 through the transmission gear train 58.

Meanwhile, a starting power transmission gear train 61 is provide between the starter motor 38 and one end of the crankshaft 16. The starting power transmission gear train 61 is comprised of a third drive gear 63 fixed to an output shaft 62 of the starter motor 38, a speed reduction gear 64 meshed with the third drive gear 63, a first idle gear 65 integral with the speed reduction gear 64, a second idle gear 66 meshed with the first idle gear 65, and the free wheel gear 40 coaxially attached to the clutch inner 41 of the starter one-way clutch 39 and meshed with the second idle gear 66.

Moreover, a part of the starting power transmission gear train 61 is covered from the outside by the shift gear switching clutch 30, and, of gears 63 to 66 constituting the starting power transmission gear train 61, a plurality of gears 64, 65, and 66 exclusive of the free wheel gear 40 on the side of the one end portion of the crankshaft 16 and the third drive gear 63 are borne on the crankcase 12 in a cantilever manner.

A holder plate 67 formed of a steel material is mounted to the outside surface of the right case half 17 of the crankcase 12 by a plurality of, for example, three, screw members 68, 68. The one-end sides of a plurality of, in this embodiment, two, support shafts 69 and 70 are fixed to the holder plate 67 by pressing-in or the like, the speed reduction gear 64 and the first idle gear 65 are rotatably borne on the other end side of the support shaft 69 on one side, and the second idle gear 66 is rotatably borne on the other end side of the support shaft 70.

Moreover, one end of the support shaft 69 which is the nearest to the third drive gear 63, of the plurality of support shafts 69 and 70, is projected from the holder plate 67 to the side of the crankcase 12, and the one end of the support shaft 69 is fitted in a positioning recessed portion 71 provided in the right case half 17 of the crankcase 12. In addition, the holder plate 67 is provided with a positioning recessed portion 72 opening to the side of the right case half 17, and a knock pin 73 rooted in the right case half 17 is fitted in the positioning recessed portion 72.

A starting operating force according to a kick operation can be inputted to the clutch gear 36 through a kick starting gear train 76. The kick starting gear train 76 is comprised of a fourth drive gear 78 mounted to a kick shaft 77 rotatably borne on the crankcase 17, a third idle gear 79 fixed to the counter shaft 28 and meshed with the fourth drive gear 78, and a second driven gear 80 relatively rotatably borne on the main shaft 27 and meshed with the third idle gear 79. The input member 31 of the shift gear switching clutch 30 is relatively non-rotatably mounted to the second driven gear 80.

Moreover, the kick starting gear train 76 is disposed between the drive gear group 29 and the clutch gear 36 along the direction of the axis of the main shaft 27.

The fourth drive gear 78 is borne on the kick shaft 77 so that it can be rotated but cannot be relatively moved in the axial direction, and a one-way clutch mechanism 120 for coupling the kick shaft 77 and the fourth drive gear 78 to each other at the time of normal rotation of the kick shaft 77 is provided between the kick shaft 77 and the fourth drive gear 78.

The one-way clutch mechanism 120 comprises a clutch body 121 fitted over the kick shaft 77 so that axial relative movement is possible but relative rotation is impossible, and a friction spring 122 for imparting frictional resistance to the rotation of the clutch body 121. Opposed surfaces of the fourth drive gear 78 and the clutch body 121 are provided with ratchet teeth 123 and 124 for transmitting only the normal rotation of the clutch body 121, or the kick shaft 77, to the fourth drive gear 78 at the time of meshing.

In addition, kick return springs 125, 125 composed of torsion coil springs are disposed in an inner and outer double structure between the right case half 17 and the kick shaft 77, and the kick shaft 77 is spring-biased toward the return side by these kick return springs 125, 125.

Figure 4:
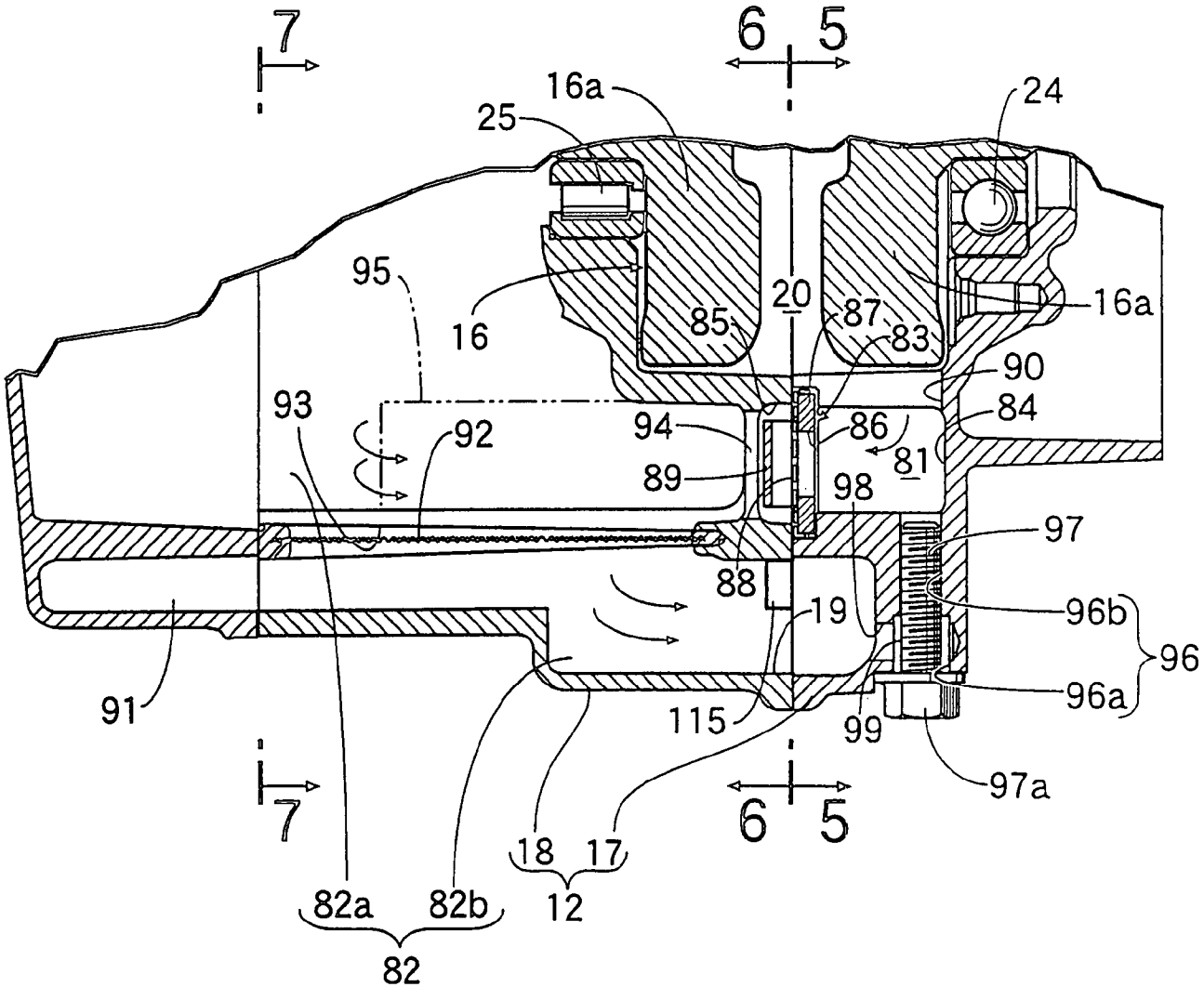
FIG. 4 is a sectional view along line 4—4 of FIG. 1.
Figure 5:
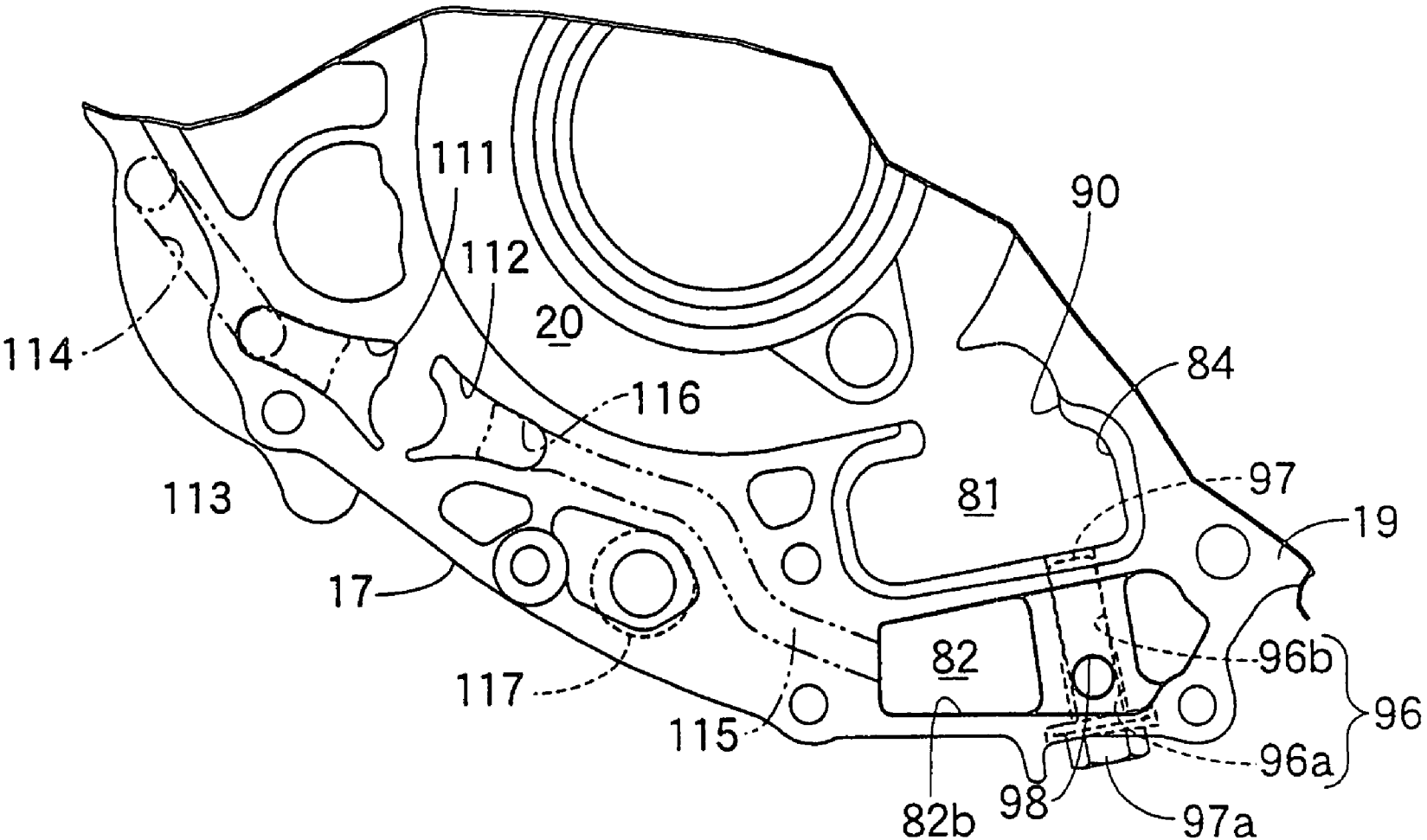
FIG. 5 is a view of a right case half, as viewed along arrows of line 5—5 of FIG. 4.
Figure 6:
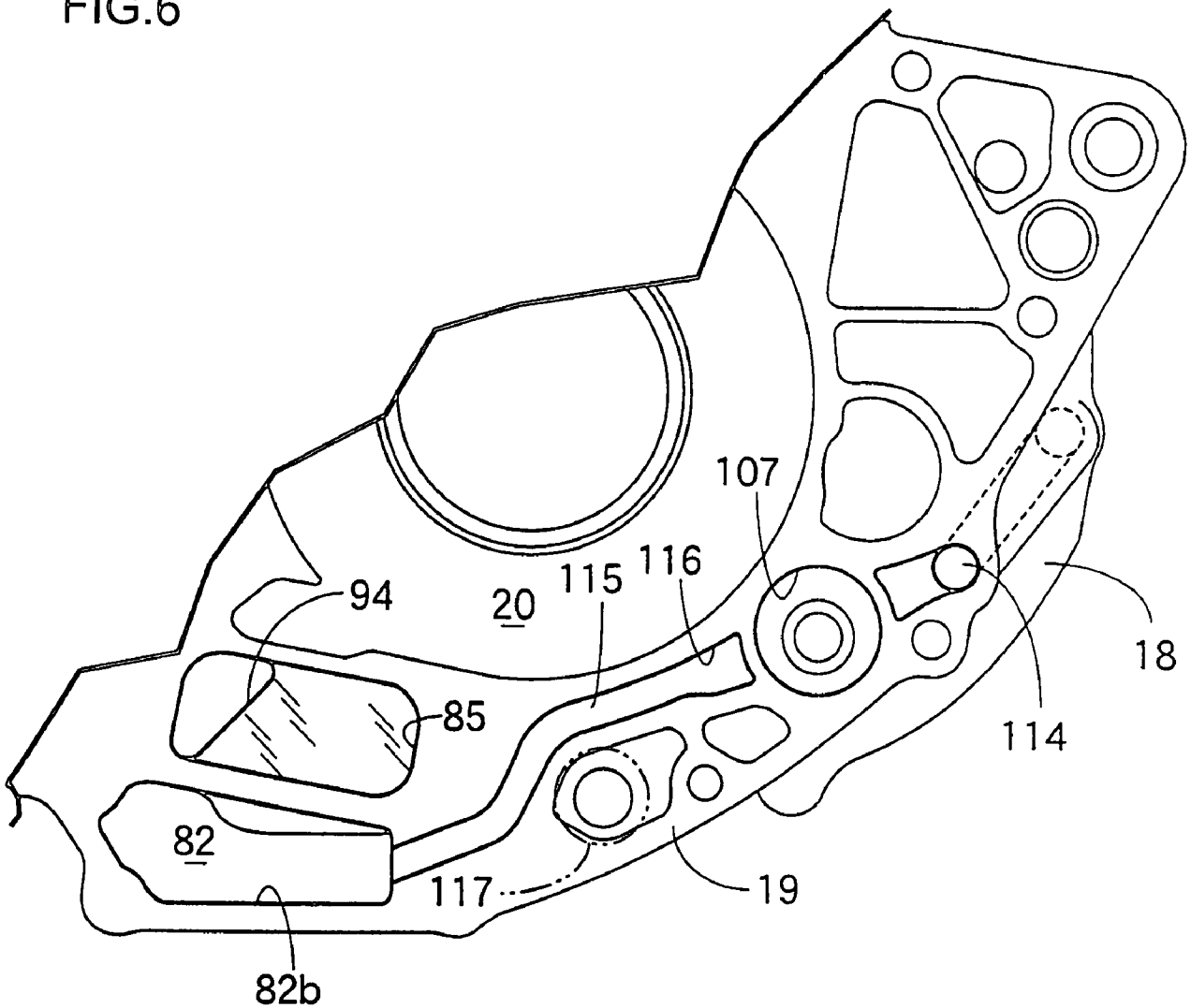
FIG. 6 is a view of a left case half, as viewed along arrows of line 6—6 of FIG. 4.

In FIGS. 4 to 6, at lower portions of the crankcase 12, there are formed a first oil reservoir 81 communicated to a lower portion of the crank chamber 20, and a second oil reservoir 82 for intermediately disposing between itself and the first oil reservoir 81 a reed valve 83 opened and closed according to pressure variations in the crank chamber 20.

The right case half 17 and the left case half 18 are provided at their lower portions with a right-side recessed portion 84 and a left-side recessed portion 85 which are opposed to each other with the mating surface 19 therebetween. The reed valve 83 is clamped between opening ends of the recessed portions 84 and 85 at the time of coupling of the right case half 17 and the left case half 18.

Specifically, the reed valve 83 comprises a valve plate 87 provided with a vale hole 86, a reed 88 attached to the valve plate 87 so as to open and close the valve hole 86, and a support plate 89 attached to the valve plate 87 so as to maintain the valve-opening position of the reed 88. An outer circumferential portion of the valve plate 87 is clamped between the opening ends of the above-mentioned recessed portions 84 and 85 in such a manner that the reed 88 and the support plate 89 are disposed on the side of the left-side recessed portion 85.

The first oil reservoir 81 is formed on the side of the right case half 17 between the right-side recessed portion 84 and the reed valve 83, and the right case half 17 is provided with a communication hole 90 for communicating a lower portion of the crank chamber 20 to the first oil reservoir 81.

Figure 7:
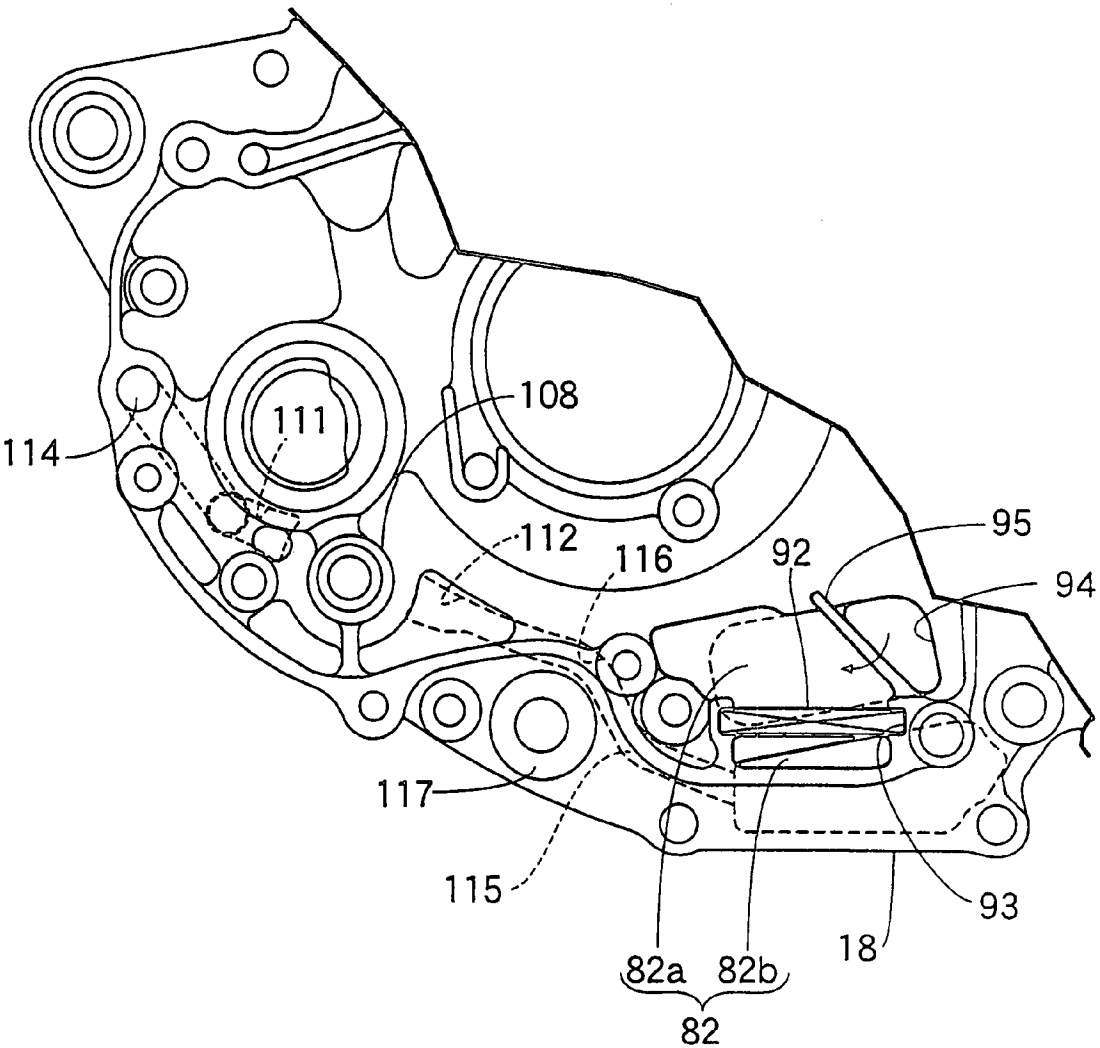
FIG. 7 is a view of the left case half, as viewed along arrows of line 7—7 of FIG. 4.

Referring to FIG. 7 also, the second oil reservoir 82 is comprised of an upper oil chamber 82*a* formed between the left case half 18 and a lower portion of a left cover 91 coupled to the left case half 18 from the outside, and a lower oil chamber 82*b* formed at lower portions of the left case 18 and the left cover 91 so as to be astride the mating surface 19. The upper oil chamber 82*a* is opened to the atmosphere through a breather passage (not shown), so that the pressure inside the second oil reservoir 82 is equal to the atmospheric pressure. In addition, the left case half 18 is provided with a mount groove 93 for mounting therein a filter 92 for partitioning the upper oil chamber 82*a* and the lower oil chamber 82*b* from each other so that the mount groove 93 is opened to the side of the left cover 91. With the left cover 91 coupled to the left case half 18, the filter 92 is prevented from slipping off from the mount groove 93.

The left-side recessed portion 85 in the left case half 18 is provided at its closing end with a lead hole 94 for leading an oil, flowing out of the first oil reservoir 81 attendant on the opening of the reed valve 83, to the side of the upper oil chamber 82*a* of the second oil reservoir 82. Besides, the left case half 18 is integrally provided with a guide wall 95 for guiding the oil, discharged through the lead hole 94 to the side of the upper oil chamber 82*a*, so that the oil from the lead hole 94 flows to the side of the left cover 91, thereby ensuring that the oil is filtered through substantially the whole surface of the filter 92.

The lowermost portion of the lower oil chamber 82*b* of the second oil reservoir 82 is disposed on the lower side of the first oil reservoir 81. A drain hole 96 extending vertically, with its upper end opened to a bottom portion of the first oil reservoir 81, is provided at a lower portion of the right case half 17 so that its intermediate portion is opened to the lowermost portion of the lower oil chamber 82*b* and that its lower end is opened in the bottom surface of the right case half 17 of the crankcase 12.

A drain bolt 97 inserted in the drain hole 96 is screw-engaged with the right case half 17 from the lower side of the crankcase 12. By the drain bolt 97, the first oil reservoir 81 and the lowermost portion of the lower oil chamber 82*b* are shut off from each other, and the second oil reservoir 82 is shut off from the outside of the crankcase 12.

Moreover, the drain hole 96 is comprised of an insertion hole portion 96*a* having a lower end opened in the bottom surface of the right case half 17, and a screw hole portion 96*b* having a diameter smaller than that of the insertion hole portion 96*a*, being coaxially continuous with the insertion hole 96*a* and having an upper end opened into the first oil reservoir 81. The right case half 17 is provided with a communication hole 98 of which one end is communicated to the lowermost portion of the lower oil chamber 82*a* of the second oil reservoir 82 and the other end is opened in the inside surface of an intermediate portion of the insertion hole 96*a*. The drain bolt 97 for forming between itself and the inside surface of the insertion hole portion 96*a* an annular chamber 99 communicated with the communication hole 98 is screw-engaged with the screw hole portion 96*b* while having its radially enlarged head portion 97*a* in liquid-tight contact and engagement with a bottom portion of the right case half 17 of the crankcase 12.

Meanwhile, the oil collecting in the lowermost portion of the second oil reservoir 82 is pumped up by the oil pump 102. The oil pump 102 is disposed in the crankcase 22 so that it is disposed on the front side relative to the crankshaft 16 in the condition where the engine is mounted on a vehicle.

The oil pump 102 has a trochoid type configuration, comprising an inner rotor 104 fixed to the inner end of a pump shaft 103, and an outer rotor 105 meshed with the inner rotor 104.

A pump chamber 106 for containing the inner rotor 104 and the outer rotor 105 is so formed that a containing recessed portion 107 provided in the left case half 18 so as to front on the mating surface 19 and the right case half 17 ensure that the mating surface 19 is clamped between the right case half 17 and the left case half 18.

The pump shaft 103 is borne in a liquid-tight and rotatable state on a support cylinder portion 108 provided in the right case half 18, and a fourth driven gear 109 is fixed to an outer end portion of the pump shaft 103 projected from the support cylinder portion 108. On the other hand, a fifth drive gear 110 is fixed to the other end portion of the balancer shaft 50, and the fifth drive gear 110 is meshed with the fourth driven gear 109, whereby the pump shaft 103 is driven to rotate.

A portion, fronting on the mating surface 19, of the right case half 17 is provided with a discharge-side recessed portion 111 communicated with the pump chamber 106, and a suction-side recessed portion 112 communicated with the pump chamber 106 so that a bearing portion 113 for bearing an inner end portion of the pump shaft 103 is formed between both of the recessed portions 111 and 112.

On the other hand, the left case half 18 is provided with an oil discharge passage 114 having one end opened at the mating surface 19 so as to be communicated with the discharge-side recessed portion 111, in such a manner as to supply an oil to lubrication portions of the engine.

In addition, the suction-side recessed portion 112 and the lowermost portion of the first oil reservoir 82 are connected to each other through an oil suction passage 115. A passage groove 116 for forming the oil suction passage 115 between the right and left case halves 17 and 18, with the mating surface 19 therebetween, is provided in at least one of the case halves 17 and 18, in this embodiment, in the left case half 18.

Besides, the oil suction passage 115 is disposed in the surroundings of the crankshaft 16, and is communicated to the lowermost portion of the second oil reservoir 82 at a front wall lower portion of the lowermost portion thereof.

Meanwhile, an engine hanger boss 117 for mounting the engine on the vehicle is provided on the lower side of the crankshaft 16 in the crankcase 12, and the oil suction passage 115 is disposed to pass between the crankshaft 16 and the engine hanger boss 117.

Next, functions of the present embodiment will be described. The second oil reservoir 82 astride the mating surface 19 is formed at a lower portion of the crankcase 12 on the lower side relative to the crankshaft 16, and the pump chamber 106 of the oil pump 102 for sucking the oil from the lowermost portion of the second oil reservoir 82 is formed between the right and left case halves 17 and 18, with the mating surface 19 therebetween. The oil suction passage 115 for connection between the oil pump 102 and the lowermost portion of the second oil reservoir 82 is formed between the case halves 17 and 18 with the mating surface 19 therebetween, by the presence of the passage groove 116 provided in at least one of the case halves 17 and 18 (in this embodiment, the left case half 18).

Namely, by coupling the right and left case halves 17 and 18 to each other at the mating surface 19 to thereby constitute the crankcase 12, the oil suction passage 115 for leading the oil in the second oil reservoir 82 to the oil pump 102 is formed. This makes it possible to prevent the engine width from increasing due to bulging of the oil passage in the left-right direction, to secure a bank angle, to reduce the number of component parts, and to contrive enhancement of the mountability, as compared with the case where oil pipes or the like are used.

In addition, the oil pump 102 is disposed on the front side relative to the crankshaft 16 in the condition of being mounted on the vehicle, and the oil suction passage 115 disposed in the surroundings of the crankshaft 16 is communicated to the second oil reservoir 82 at the front wall lower portion of the lowermost portion of the second oil reservoir 82. Therefore, it is possible to set the volume of the second oil reservoir 82 to be comparatively large, while making it possible to set the minimum height of the crankcase 12 from the ground to be comparatively high, by disposing the oil suction passage 115 closer to the crankshaft 16.

Furthermore, the crankcase 12 is provided with the engine hanger boss 117 on the lower side relative to the crankshaft 16, and the oil suction passage 115 is disposed to pass between the crankshaft 16 and the engine hanger boss 117. Since the internal pressure in the oil suction passage 115 is low and the seal width of the oil suction passage 115 at the mating surface 19 can be set to be small, it is possible to set the engine hanger boss 117 at a comparatively high position, and to set the minimum height of the crankcase 12 from the ground to be higher.

Meanwhile, the crankcase 12 is provided with the first oil reservoir 81 communicated to a lower portion of the crank chamber 20, and the second oil reservoir 82 for intermediately providing between itself and the first oil reservoir 81 the reed valve 83 opened and closed according to pressure variations in the crank chamber 20. The first and second oil reservoirs 81 and 82 are formed in the crankcase 12 so that the lowermost portion of the second oil reservoir 82 is disposed on the lower side of the first oil reservoir 81. The drain hole 96 extending vertically with its upper end opened at the bottom portion of the first oil reservoir 81 is formed at a lower portion of the right case half 17 of the crankcase 12, with its intermediate portion opened at the lowermost portion of the second oil reservoir 82 and with its lower end opened in the bottom surface of the crankcase 12. The drain bolt 97 inserted in the drain hole 96 so as to shut off the first oil reservoir 81 and the lowermost portion of the second oil reservoir 82 from each other and to shut off the second oil reservoir 82 from the outside of the crankcase 12 is screw-engaged with the right case half 17 from the lower side of the crankcase 12.

Therefore, by loosening the single drain bolt 97 and releasing it from the crankcase 12, the oil in both the first and second oil reservoirs 81 and 82 can be discharged to the outside of the crankcase 12, and, by screw-engaging the drain bolt 97 into the right case half 17 and fastening it, both the first and second oil reservoirs 81 and 82 can be shut off from the outside of the crankcase 12. Accordingly, in discharging the oil from the first and second oil reservoirs 81 and 82, it is possible to contrive a reduction in the number of component parts and to contrive enhancement of the maintainability.

Moreover, the drain hole 96 is comprised of the insertion hole portion **96*a* having a lower end opened in the bottom surface of the right case half 17, and the screw hole portion 96*b* smaller in diameter than the insertion hole portion 96*a*, coaxially continuous with the insertion hole portion 96*a*, and having an upper end opened into the first oil reservoir 81. The right case half 17 is provided with the communication hole 98 of which one end is communicated with the lowermost portion of the second oil reservoir 82 and the other end is opened in the inside surface of an intermediate portion of the insertion hole portion 96*a*. The drain bolt 97 for forming between itself and the inside surface of the insertion hole portion 96*a* the annular chamber 99 communicated with the communication hole 98 is screw-engaged with the screw hole portion 96*b*, with its radially enlarged head portion 97*a* in liquid-tight contact and engagement with the bottom portion of the right case half 18**.

Such a structure of the drain hole 96 as above makes it possible to communicate a lower position as possible in the lower portion of the second oil reservoir 82 to the drain hole 96, while setting comparatively large the length of the screw hole portion **96*b* necessary for firmly fastening the drain bolt 97 to the crankcase 12. As a result, it is possible to reduce as much as possible the residual amount of the oil in the first oil reservoir 81, and to reduce as much as possible the residual amount of the oil in the second oil reservoir 82, too. In addition, when the oil oozing out to the side of the insertion hole portion 96***a* through the gap between the drain bolt 97 and the screw hole portion 96*b* due to pressure variations in the first oil reservoir 81 is led through the communication hole 98 to the side of the second oil reservoir 82, it is possible to preventing the oil from oozing out to the exterior of the crankcase 12, so that a synergistic effect with maintainability can be obtained in discharging the residual oil in both the first and second oil reservoirs 81 and 82.

In addition, the main shaft 27 which is rotatably borne on the crankcase 12 with its axis parallel to the crankshaft 16 and to which the drive gear group 29 for a plurality of speed change stages is mounted is rotatably borne on the crankcase 12. The shift gear switching clutch 30 for switching ON and OFF the transmission of power between the crankshaft 16 and the main shaft 27 is mounted to one end portion of the main shaft 27. The power transmission gear train 34 including the clutch gear 36 rotated together with the input member 31 of the shift gear switching clutch 30 is provided between one end portion of the crankshaft 16 and the input member 31. The kick starting gear train 76 capable of inputting a starting operating force according to a kick operation to the clutch gear 36 is disposed between the drive gear group 29 and the clutch gear 36 along the direction of the axis of the main shaft 27. The starter one-way clutch 39 interposed between the starter motor 38 and the crankshaft 16 is disposed between the drive gear group 29 and the clutch gear 36 along the direction of the axis of the main shaft 27, and is mounted to the crankshaft 16.

Such a configuration ensures that, with the starter one-way clutch 39 mounted to the crankshaft 16, it is possible to comparatively reduce the power transmission load borne by the starter one-way clutch 39, to contrive a reduction in the size of the starter one-way clutch 39 and, hence, to contrive a reduction in the size of the engine. Moreover, since the starter one-way clutch 39 and the kick starting gear train 76 are disposed between the drive gear group 29 and the clutch gear 36 along the direction of the axis of the main shaft 27, it is possible to effectively dispose the kick starting gear train 76 in a free space generated between the drive gear group 29 and the clutch gear 36 due to the arrangement of the starter one-way clutch 39, in enabling the starting of the engine by the starter motor 38 and enabling the starting of the engine by the kick operation. Thus, it is possible to prevent the engine from being enlarged in size, also by the arrangement of the kick starting gear train 76.

Besides, the first drive gear 35 constituting a part of the power transmission gear train 34 is fixed to one end portion of the crankshaft 16 projecting from the crankcase 12, with the ball bearing 24 interposed between the crankcase 12 and the right case half 17. The starter one-way clutch 39 and the second drive gear 44 constituting a part of the accessory-driving power transmission gear train 43 and fixed to the crankshaft 16 are disposed side by side between the first drive gear 35 and the ball bearing 24. Therefore, it is possible to dispose the accessory-driving power transmission gear train 43 by effectively making the most of the space for disposing the kick starting gear train 76, thereby contributing to a reduction in the size of the engine.

The starter one-way clutch 39 comprises the clutch inner 41 to which power is inputted from the starter motor 38, and a clutch outer 42 having the inner circumference boss portion 42*a* for relatively rotatably bearing the clutch inner 41 and being relatively non-rotatably mounted to the crankshaft 16. The inner circumference boss portion 42*a* is disposed between the first drive gear 35 and the second drive gear 44.

Therefore, chattering of the starter one-way clutch 39 in the direction along the axis of the crankshaft 16 can be restrained without using a component part for exclusive use, and it is possible to contrive enhancement of durability of the starter one-way clutch 39 and to contrive a reduction of noise, while obviating an increase in the number of component parts.

Furthermore, the first drive gear 35, the inner circumference boss portion 42*a* of the clutch outer 42, and the second drive gear 44 are relatively non-rotatably mounted to the crankshaft 16 in the state of making contact with each other. The second drive gear 44 is integrally provided with the cylinder portion 44*a* making contact with the outside surface of the inner ring of the ball bearing 24 interposed between the crankshaft 16 and the crankcase 12 on the inner side in the axial direction relative to the second drive gear 44, and the bolt 46 having the radially enlarged head portion 46*a* making contact and engagement with the outer end of the first drive gear 35 is coaxially screw-engaged with one end portion of the crankshaft 16.

Therefore, the first drive gear 35, the clutch outer 42, and the second drive gear 44 are fixed to the crankshaft 16 by use of a simple structure which does not need other component parts than the bolt 46 and which is reduced in the number of component parts. Moreover, the first drive gear 35, the clutch outer 42, and the second drive gear 44 are prevented from being inclined relative to the axis of the crankshaft 16, whereby it is possible to further contrive enhancement of durability of the starter one-way clutch 39 and a reduction of noise.

Meanwhile, the starter motor 38 is attached to the right case half 17 of the crankcase 12, and a part of the starting power transmission gear train 61 provided between the starter motor 38 and one end portion of the crankshaft 16 is covered from the outside by the shift gear switching clutch 30 coupled to and operated in conjunction with the crankshaft 16. Of the gears 63, 64, 65, 66, 40 constituting the starting power transmission gear train 61, a plurality of the gears 64 to 66 exclusive of the free wheel gear 40 on the side of the one end portion of the crankshaft 16 and the third drive gear 63 fixed to the output shaft 62 of the starter motor 38 are borne on the crankcase 12 in a cantilever manner. Therefore, it is possible to dispose the shift gear switching clutch 30 closer to the side of the crankcase 12 in the direction along the axis of the crankshaft 16, and to reduce the size of the engine in the direction along the axis of the crankshaft 16.

Moreover, the one-end sides of a plurality of (in this embodiment, two) support shafts 69, 70 are fixed to the holder plate 67 attached to the right case half 17 of the crankcase 12, and, of the plurality of gears 63 to 66, and 40 constituting the starting power transmission gear train 61, a plurality of the gears 64 to 66 exclusive of the free wheel gear 40 and the third drive gear 63 are rotatably borne on the other-end sides of the support shafts 69, 70. Therefore, the holder plate 67 on which the plurality of gears 64 to 66 constituting a part of the starting power transmission gear train 61 have been mounted can be attached to the crankcase 12, so that mountability can be enhanced. Moreover, while the crankcase 12 is formed of an aluminum alloy, the holder plate 67 is formed of a steel material. Therefore, it is possible to reduce the load on the right case half 17 at the portions for supporting the gears 64 to 66, and to form the holder plate 67 in a comparatively small material thickness.

Furthermore, one end of the support shaft 69 which is the nearest to the third drive gear 63, of the plurality of support shafts 69 and 70, is projected from the holder plate 67 to the side of the right case half 17 and is fitted in the positioning recessed portion 71 in the right case half 17. Therefore, it is possible to enhance the mountability of the holder plate 67 onto the crankcase 12, while contriving a reduction in the number of component parts, by utilizing the support shaft 69 as a knock pin. Moreover, since support rigidity can be enhanced by supporting on the crankcase 12 the support shaft 69 for the speed reduction gear 64 rotated at a high speed, it is possible to contrive enhancement of durability and to contrive a reduction of meshing noises.

While one embodiment of the present invention has been described above, the present invention is not limited to the above embodiment, and various design modifications are possible without departure from the present invention as defined by claims.

The above specification, examples and data provide a complete description of the manufacture and use of the composition of the invention. Since many embodiments of the invention can be made without departing from the spirit and scope of the invention, the invention resides in the claims hereinafter appended.

We claim:

1. An engine starting system comprising:

a starter motor;

a crank case;

a crank shaft; and an accessory that is coupled to and operates in conjunction with said crankshaft; and a starting power transmission gear train rotatably disposed on the crankcase between an end portion of the crankshaft and the starter motor, wherein a part of said starting power transmission gear train is covered by the accessory, and wherein the starting power transmission includes a plurality of gears exclusive of a driven gear on a side of said end portion of the crankshaft and a drive gear fixed to an output shaft of said starter motor, the plurality of gears being disposed on said crankcase in a cantilever manner.

2. An engine starting system according to claim 1, further comprising:

a holder plate attached to said crankcase; and a plurality of support shafts having first end sides and second end sides wherein the first end sides are attached to said holder plate and said plurality of gears of the starting power transmission are rotatably disposed on said second end sides of said plurality of support shafts.

3. An engine starting system according to claim 2, wherein an end of a support shaft nearest to a drive gear of said plurality of support shafts is projected from said holder plate to a side of said crankshaft and is fitted therein.

* * * * *